US006011452A

United States Patent [19]

Loukkola

[11] Patent Number: 6,011,452

[45] Date of Patent: Jan. 4, 2000

[54] FILTERING ARRANGEMENT WITH IMPEDANCE STEP RESONATORS

[75] Inventor: Jukka Loukkola, Kempele, Finland

[73] Assignee: LK-Producks OY, Kempele, Finland

[21] Appl. No.: 08/927,644

[22] Filed: Sep. 11, 1997

[30] Foreign Application Priority Data

Sep. 11, 1996 [FI] Finland ..... 963578

[51] Int. Cl.[7] ..... H01P 7/00

[52] U.S. Cl. ..... 333/235; 333/219; 333/219.1; 455/334

[58] Field of Search ..... 333/175, 176, 333/172, 202, 204, 206, 235, 219.1, 101, 219; 455/334, 177.1, 266, 176.1, 191.1, 193.2; 370/339, 272, 275, 297

[56] References Cited

U.S. PATENT DOCUMENTS

| | | | |
|---|---|---|---|
| 4,757,288 | 7/1988 | West | 333/206 |
| 5,103,197 | 4/1992 | Turunen | 333/206 |
| 5,177,458 | 1/1993 | Newell et al. | 333/206 |
| 5,298,873 | 3/1994 | Ala-Kojola | 333/235 |
| 5,387,886 | 2/1995 | Takalo et al. | 333/101 |
| 5,392,011 | 2/1995 | Li | 333/174 |
| 5,506,554 | 4/1996 | Ala-Kojola | 333/206 |
| 5,508,668 | 4/1996 | Prokkola | 333/202 |
| 5,604,471 | 2/1997 | Rattila et al. | 333/302 |
| 5,675,301 | 10/1997 | Nappa et al. | 333/302 |
| 5,734,305 | 3/1998 | Ervasti | 333/204 |
| 5,739,735 | 4/1998 | Pyykko et al. | 333/129 |

*Primary Examiner*—Wellington Chin
*Assistant Examiner*—Isaak R. Jama
*Attorney, Agent, or Firm*—Darby & Darby

[57] ABSTRACT

A radio-frequency filter for a radio apparatus operating on two frequency bands is based on impedance step resonators, wherein two interconnected resonator sections (L2, L1) having different impedances are dimensioned such that the resonator's fundamental resonating frequency (f0) is on the lower operating frequency band and a certain harmonic resonating frequency (fs1) is on the higher operating frequency band. The filter may have separate ports (port 2, port 3) for the signals of the different frequency bands and they can be isolated from each other using additional filtering (LC1, LC2).

8 Claims, 6 Drawing Sheets

FILTERING ARRANGEMENT WITH IMPEDANCE STEP RESONATORS

BACKGROUND OF THE INVENTION

The invention relates to radio-frequency filters which, due to their construction, have multiple simultaneous operating frequencies.

Filters based on transmission line resonators are fundamental components in modern radio apparatuses. Categorized according to the frequency response, the commonest filter types are band rejection and band pass filters which are used to attenuate high-frequency signals on a desired frequency band (band rejection) or outside a certain frequency band (band pass). In addition, low pass and high pass filters are used. Transmission line resonators, the resonating frequencies of which determine a filter's frequency response, are usually cylindrical coil conductors, or helixes, plated grooves or holes formed in a dielectric medium, coaxial outer/inner conductor pairs or strip lines formed on a board-like substrate. There are usually from two to about eight resonators in a filter. A filter is connected to the rest of the radio apparatus via input, output and control signal ports.

Mobile and cordless telephones are the most important application field of portable radio technology. In different parts of the world there are cellular telephone systems in use that differ from each other significantly in their operating frequency ranges. Of digital cellular telephone systems, the operating frequencies of the Global System for Mobile Telecommunications (GSM) are 890–960 MHz, those of the Japanese Digital Cellular (JDC) system in the 800 and 1500 MHz bands, of the Personal Communication Network (PCN), 1710–1880 MHz, and of the Personal Communication System (PCS), 1850–1990 MHz. The operating frequencies of the American AMPS mobile phone system are 824–894 MHz and those of the European cordless telephone system, DECT, 1880–1900 MHz.

With the mobility of people and communication between people increasing, there is a growing need for general-purpose phones that operate in different networks according to network availability and/or service prices. In dual mode radio telecommunications, the GSM and DECT (Digital European Cordless Telephone), or GSM and PCN (Personal Communication Network) or other systems can operate as pairs. The dual mode capability is also taken into account in the so-called third generation cellular systems (Universal Mobile Telecommunication System, UMTS/Future Public Land Mobile Telecommunications System, FLPMTS).

In a radio apparatus operating at two frequencies the filtering arrangement can be realized in two ways. In the first solution, the filters must meet the same requirements at both frequencies. The band pass filter must have a pass band at the both operating frequencies of the system, the band rejection filter must have corresponding stop bands and so forth. In the second solution, radio signals of different frequencies are directed via different routes, in which case the apparatus has got two parallel filters for each filtering function. The first solution is more advantageous in apparatuses where minimization of physical size is important.

In the design of shared filters, the choice of resonating frequencies for the transmission line resonators has proven problematic. The system operating frequencies listed above show that if the operating frequency of the first system (the one having the lower operating frequency of the two) is f0, the frequency of the second system for a dual mode phone is typically in the range from 1.5*f0 to 2.5*f0. A constant-impedance $\lambda/4$ transmission line resonator with a fundamental resonating frequency of f0 has odd harmonic resonating frequencies (fs1, fs2, . . . ) at the odd multiples of the fundamental resonating frequency. FIG. 1 shows a 2-circuit band pass filter implemented with constant-impedance $\lambda/4$ transmission line resonators Ra an Rb. FIG. 2 shows a typical frequency response for the filter. The filter's first pass band is at the frequency f0 and the next pass band, determined by the resonators' first odd harmonic resonating frequency fs1, is at the frequency 3*f0. The harmonic frequency is too high to be used for dual band/dual mode filtering.

SUMMARY OF THE INVENTION

The object of this invention is to provide a filtering arrangement wherein the filtering parts of a radio apparatus operating at two operating frequencies can employ at least partly shared resonators.

The object of the invention is achieved by using in the filters of a radio apparatus impedance step resonators the specifications of which are chosen such that they operate at the desired frequencies.

The filtering arrangement according to the invention is characterized in that the fundamental resonating frequency of the impedance step resonators is on the first frequency band of a dual band radio system and a certain harmonic resonating frequency is on the second frequency band of the radio system.

The invention is based on the perception that the harmonic resonating frequency of a transmission line resonator can be shifted down from the relatively high value mentioned above to a desired second operating frequency band using a so-called impedance step construction. The idea of changing the impedance of a resonator in the direction of its longitudinal axis is known. but the resulting shift in the resonating frequency has been regarded as only a means to attenuate harmonic frequencies or to influence the inter-resonator electromagnetic coupling in the filters of a radio apparatus designed for one frequency band. In the present invention, the dimensioning of the impedance step resonator or resonators shifts the chosen harmonic resonating frequency in such a way that the fundamental frequency of the resonator or resonators produces for a filter consisting of the resonators a desired frequency response in the first operating frequency range and the harmonic frequency produces a corresponding frequency response for the filter in the second operating frequency range.

BRIEF DESCRIPTION OF THE DRAWINGS

The invention is below described in greater detail with reference to the preferred embodiments disclosed by way of example and to the attached drawings, wherein.

DETAILED DESCRIPTION OF THE INVENTION

Figure 2:
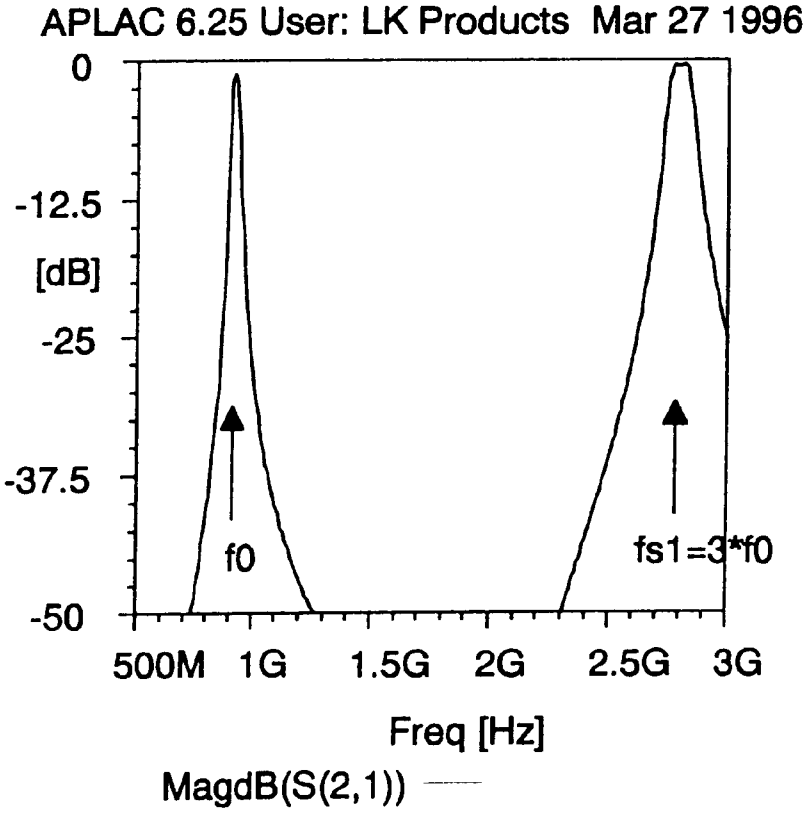
Fig. 2 PRIOR ART
FIG. 2 shows the frequency response of the filter according to FIG. 1.
Figure 1:
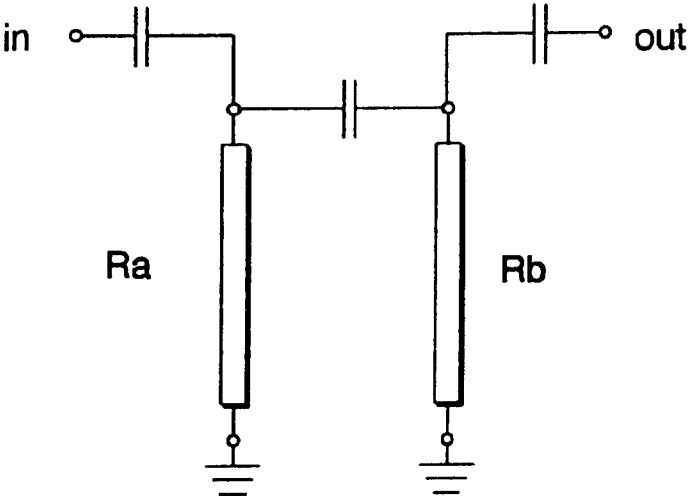
Fig. 1 PRIOR ART
FIG. 1 shows a known band pass filter.
Figure 3:
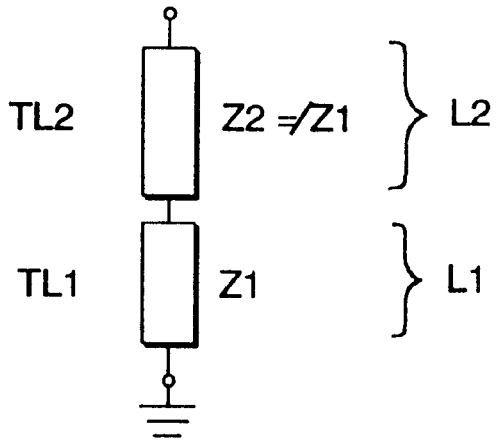
Fig. 3 PRIOR ART
FIG. 3 shows an impedance step resonator which is known as such.

FIGS. 1 to 3 relate to the description of the prior art and FIGS. 4 to 11 relate to the description of the invention. Like elements in the drawings are denoted by like reference designators.

In addition to constant-impedance λ/4 transmission line resonators, an impedance step resonator, schematically depicted in FIG. 3, is employed by certain filters designed for mobile phone applications. The λ/4 resonator in the figure comprises two consecutive transmission lines TL1 and TL2, and the impedances of its open and short-circuited ends are unequal. In prior art arrangements, the use of impedance step resonators aims at shortening the physical length of the resonator construction and/or improving the harmonic attenuation characteristics of the filter. U.S. Pat. No. 4 506 241 discloses how a first odd harmonic resonating frequency (fs1) can be shifted further up from frequency 3*f0 so that the harmonic attenuation requirements of a filter in a system in the frequency range f0 can be met. As is known, the construction is also used in a filter where one dielectric block comprises several resonators. U.S. Pat. No. 4 733 208 discloses how the impedance step construction is applied to the adjustment of electromagnetic coupling between such resonators.

In the arrangement according to the invention, the impedance step resonator has such specifications that its fundamental resonating frequency, marked f0 below, is at the lower operating frequency of the dual band or dual mode apparatus and the odd harmonic resonating frequency (fs1) is at the higher operating frequency of the apparatus. Then that resonator can be used for filtering in both systems.

Figure 4:
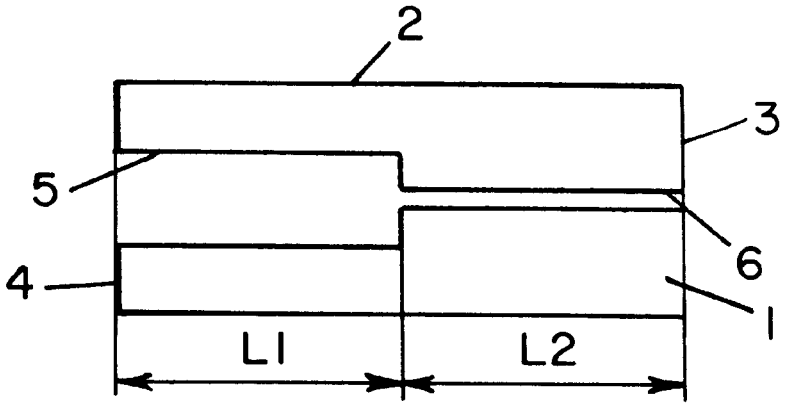
FIG. 4 shows in a schematic manner a construction of an impedance step resonator.

FIG. 4 is a longitudinal section of a known implementation of the impedance step resonator. A dielectric body block 1 is bounded by two parallel end surfaces 3 and 4, which customarily are called an upper surface (3) and a lower surface (4) without any restrictions to the operating position of the construction. The block is further bounded by side surfaces 2, which are perpendicular to the end surfaces and most often parallel in pairs, thereby making the block 1 a rectangular prism. The block has a cylindrical hole for a resonator, and a first section 5 of the hole has a diameter greater than that of a second section 6. The length of section 5 is denoted by L1 and the length of section 6 by L2.

Of the block surfaces at least one side surface 2, the inner surfaces of the holes 5, 6 and at least part of the lower surface 4 are coated with an electrically conductive material. The resonator hole 6 opening to the upper surface 3 is disconnected from the coating, either so that the entire upper surface 3 is uncoated or so that there is an electrically non-conductive area around the hole. It is also possible to form the resonator hole so that it does not open to the upper surface buth the resonator hole is closed on the side of the upper surface 3. The coating on the lower surface 4 is formed in such a manner that it is connected to the resonator hole coating and hence to the side surface coating, thereby forming a short-circuited end for the resonator. In the application shown in FIG. 4, the impedance step is formed by making a step in the resonator hole in such a manner that the diameter of the hole facing the filter's upper surface 3 is smaller than that of the hole facing the lower surface 4. Thus, the holes with different diameters have different impedances. In this case, the impedance of the hole 5 facing the short-circuited end is smaller than that of the hole 6 facing the open end. The resonator is physically a little longer in the horizontal direction of the drawing than a constant-impedance transmission line resonator.

The invention is not limited to a dielectric resonator arrangement like the one described above but it can be applied in many ways. Impedance step resonators can also be strip line resonators, for example. In a dielectric resonator, the impedance step need not necessarily be achieved by means of a step in the inner conductor but the step may also be located on the plated outer surface of the body block.

Mathematics found in "A design method of band-pass filters using dielectric-filled coaxial resonators. IEEE TMTT No. 2 February 1985" can be used for the dimensioning of the resonator. Let us examine a resonator to be used in the filtering of the receive branches of the GSM system and the DCS 1800 system, for instance. The fundamental resonating frequency f0 must then be about 950 MHz and fs1 must be about 2*f0. To simplify the dimensioning, the physical lengths of the resonator's upper and lower parts are made equal (L1=L2). According to the aforementioned scientific publication, fs1 is given as the function of f0 and K by the formula $$fs1 = \left(\frac{\pi}{\tan^{-1}\sqrt{K}} - 1\right) * f0, \tag{1}$$

where K represents the ratio of impedance Z2 to impedance Z1. K can be solved by writing the formula (1) as follows:

$$K = \tan\left[\pi * \frac{f0}{(f0 + fs1)}\right]^2. \tag{2}$$

Considering that fs1=2*f0, we get K=3. So, in our example Z2/Z1=K=3, ie. the transmission line upper end impedance Z2=3*Z1.

Let us next calculate the physical lengths (L1=L2) of the resonator's lower and upper parts.

$$L1 = L2 = \tan^{-1}\sqrt{K} / \beta \tag{3}$$

$$\text{where } \beta = 2 * \pi * \frac{f0}{c} * \sqrt{\varepsilon_r} \text{ and}$$

Above we established that K=3, and $\epsilon_{96}$ is a constant depending on the material used, so formula (3) gives us the length of the resonator parts 5 and 6 which only depends on the frequency f0. One should note that the same formulas apply to any ratio of the frequencies f0 and fs1. Substituting the desired frequency values in formula (2) we get a value for K which together with frequency fo determines the length of the resonator parts according to formula (3).

Figure 6:
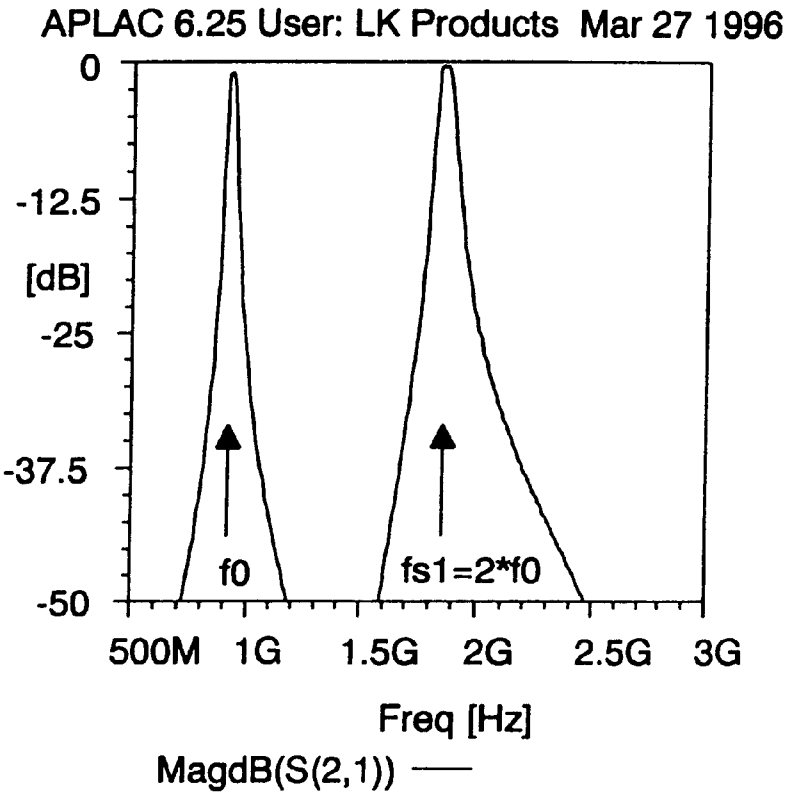
FIG. 6 shows the frequency response of the filter according to FIG. 5.
Figure 5:
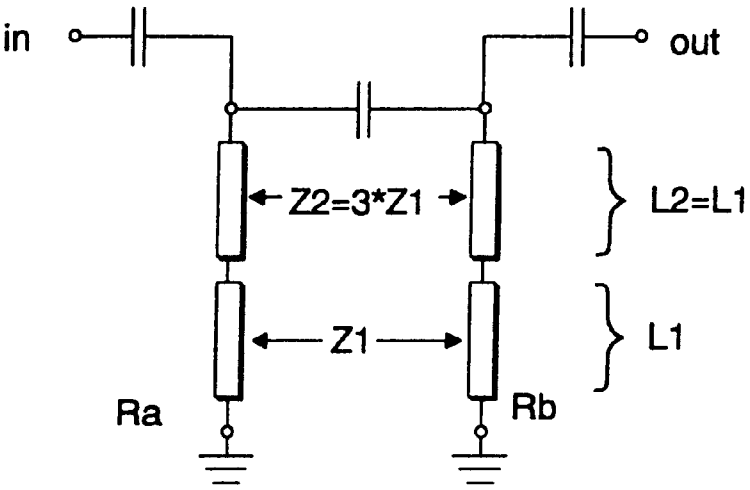
FIG. 5 shows a band pass filter according to the invention.

FIG. 5 is a circuit diagram of a band pass filter wherein the impedances of the parts of impedance step resonators Ra and Rb are chosen such that Z2=3 *Z1. FIG. 6 shows the simulated frequency response of such a filter. We can see that the filter has two obvious pass bands the first of which is at frequency f0 and the second is at a frequency two times higher.

Figure 8:
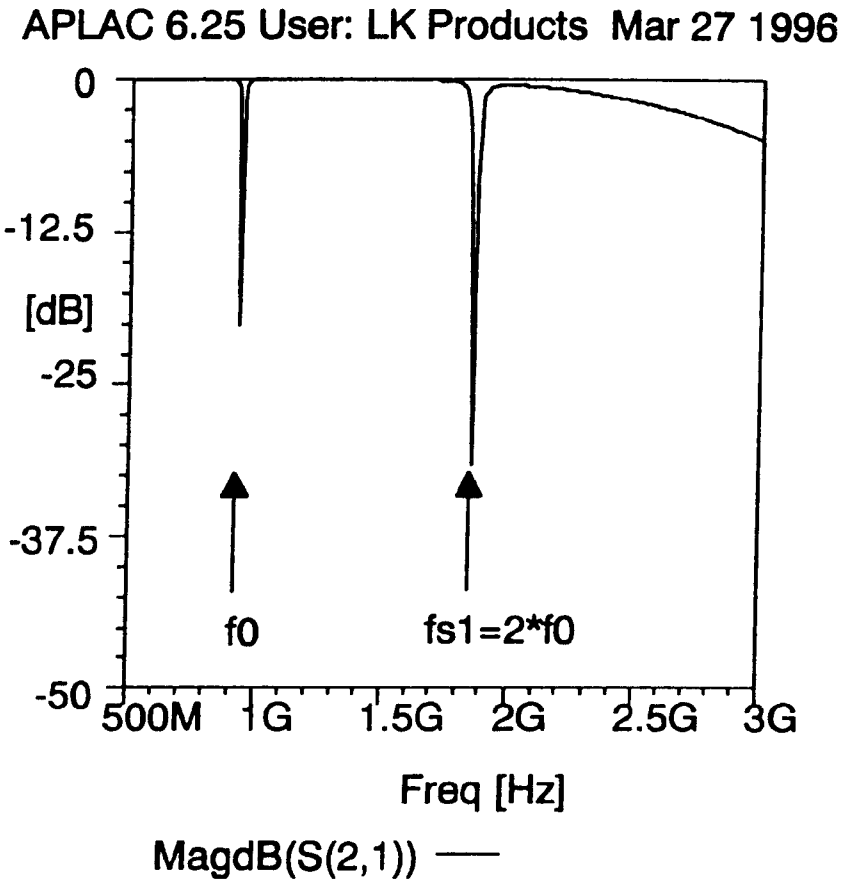
FIG. 8 shows the frequency response of the filter according to FIG. 7.
Figure 7:
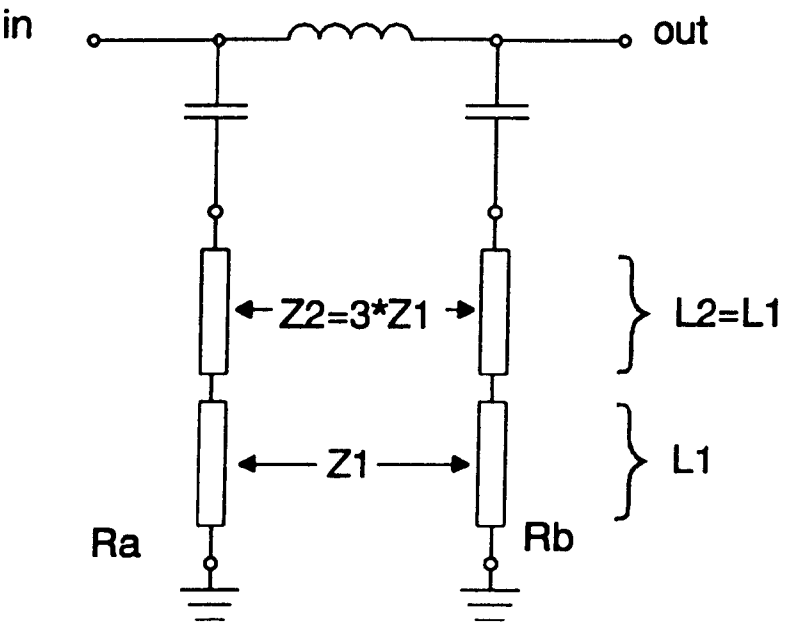
FIG. 7 shows a band rejection filter according to the invention.

FIG. 7 is a circuit diagram of a band pass filter wherein the impedances of the parts of impedance step resonators Ra and Rb are again chosen such that Z2=3 *Z1. FIG. 8 shows the simulated frequency response of such a filter. We can see that the filter has two obvious stop bands the first of which is at frequency f0 and the second is at a frequency two times higher.

Figure 9:
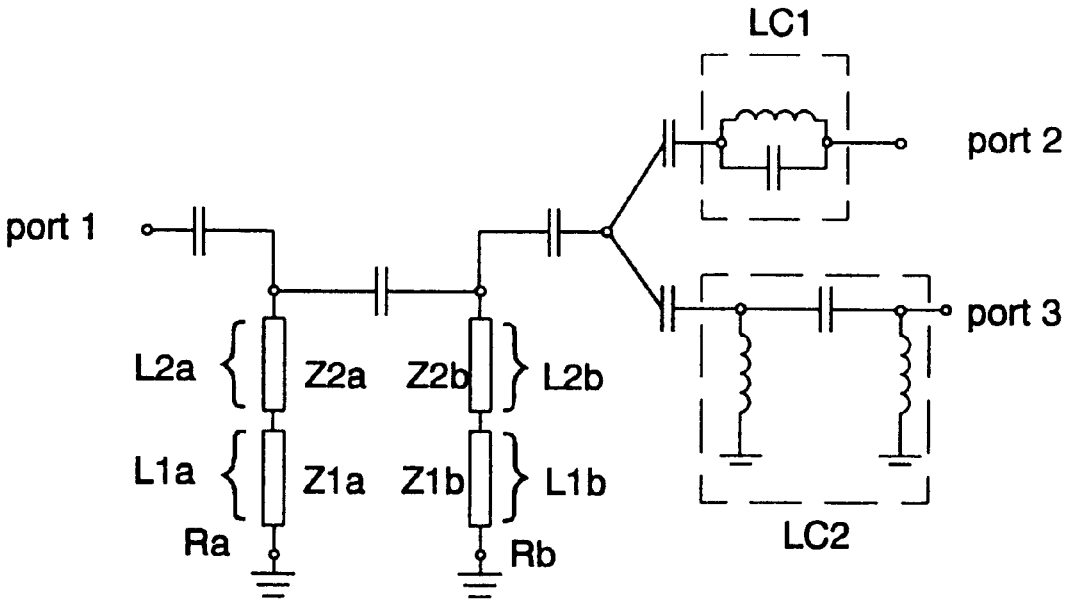
FIG. 9 shows a dual mode filter according to the invention.

It is easy to arrange in the filters shown in FIGS. 5 and 7 separate ports for the higher and lower frequency band systems. Furthermore, the specifications of the different systems, which set minimum requirements for the attenuation of certain frequency bands, may require additional filtering at the ports. FIG. 9 shows a filter according to an advanced embodiment of the invention, where the basic element is a filter according to FIG. 5. The port (in) depicted as an input port in FIG. 5 is an antenna port (port 1) in the filter shown in FIG. 9. From an output port (out) according to FIG. 5 the signal path branches into a lower frequency band branch (port 2) and higher frequency band branch (port 3). In the lower frequency band branch (port 2) there is a known LC circuit LC1 comprising an inductive and a capacitive element connected in parallel, which attenuates signals propagating at frequency 2*f0. In the higher frequency band branch (port 3) there is an LC high pass chain LC2 according to a known construction to provide sufficient attenuation in this branch at frequency f0 and to provide the necessary isolation between ports 2 and 3.

Figure 11:
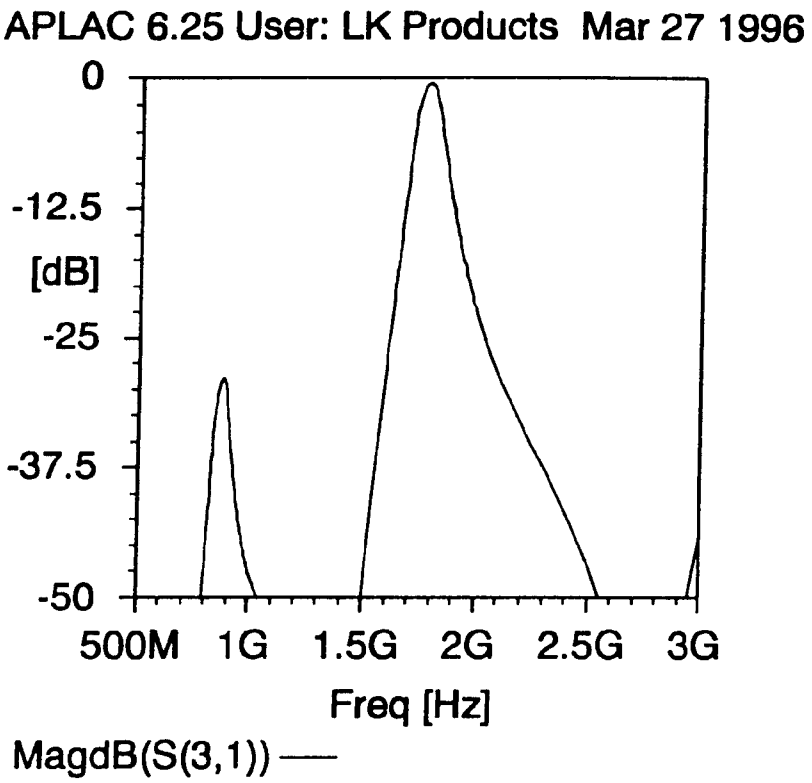
FIG. 11 shows the pass attenuation between ports 1 and 3 of the filter according to FIG. 9.
Figure 10:
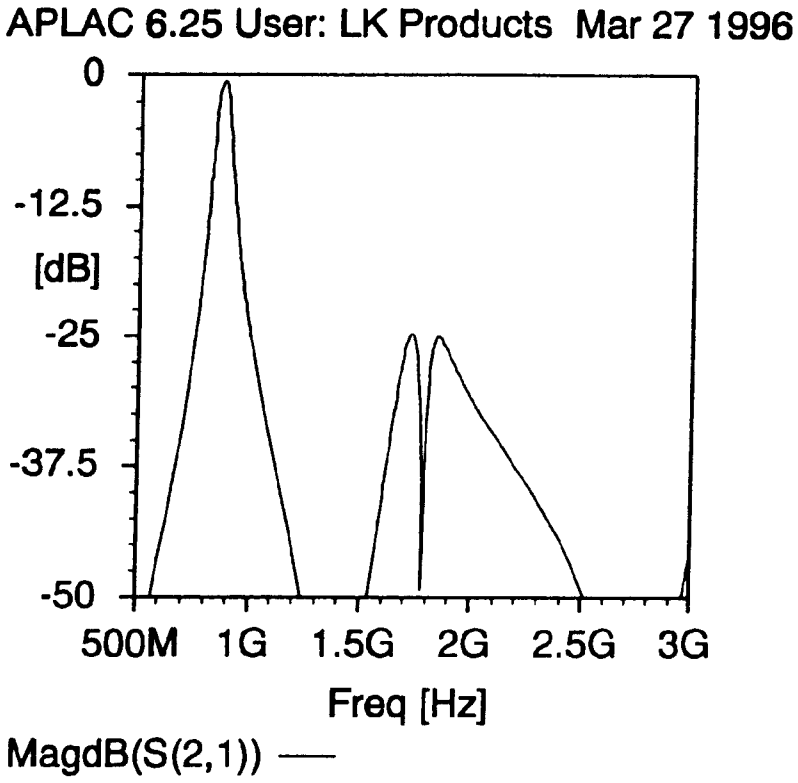
FIG. 10 shows the pass attenuation between ports 1 and 2 of the filter according to FIG. 9.

FIG. 10 illustrates simulated pass attenuation between ports 1 and 2 for a filter according to FIG. 9, and FIG. 11 illustrates simulated pass attenuation between ports 1 and 3 for the same filter. According to FIG. 10, the filter has between ports 1 and 2 a pass band at f0 and a narrow stop band at a frequency two times higher. The attenuation at both sides of the narrow stop band is at least −25 dB. According to FIG. 11, the filter has between ports 1 and 3 a pass band at the higher operating frequency and an attenuation of at least −28 dB at f0.

Although an impedance step resonator, in the direction of its longitudinal axis, is usually longer than a single-frequency constant-impedance resonator corresponding to either of its operating frequencies, the arrangement according to the invention saves space in a radio apparatus because one resonator replaces two separate resonators. If a whole filter can be implemented with single resonators instead of two parallel resonator groups, the saving of space is considerable.

I claim:

1. A radio-frequency filter for a radio apparatus operating both on a first frequency band and on a second frequency band higher than the first frequency band, the filter comprising:

at least one transmission line resonator having a first section with a first impedance and a second section coupled to the first section and with a second impedance different from the first impedance;

the magnitudes of the first and second impedances selected such that said transmission line resonator has a fundamental resonating frequency at substantially said first frequency band and a harmonic resonating frequency at substantially said second frequency band.

2. The radio-frequency filter of claim 1, wherein said transmission line resonator further comprises an open end and a short-circuited end, said first section being bounded by said open end and said second section being bounded by said short-circuited end, the first impedance being higher than the second impedance.

3. The radio-frequency filter of claim 2, comprising:

a dielectric body block having a surface which is at least partly coated with an electrically conductive material and which is bounded by at least a first end surface and a second end surface substantially parallel to the first end surface;

said transmission line resonator comprising a hole extending through said body block from said first end surface to said second end surface, the hole defining an inner surface of the body block, the inner surface being coated with an electrically conductive material which is electrically connected with the electrically conductive coating of said body block via said second end surface.

4. The radio-frequency filter of claim 3, wherein said hole comprises a first hole section bounded by said first end surface and an intermediate point between said first and second end surface and a second hole section bounded by said second end surface and said intermediate point, a diameter of said first hole section being smaller than a diameter of said second hole section.

5. The radio-frequency filter of claim 3, wherein said body block comprises a first block section bounded by said first end surface and an intermediate point between said first and second end surface and a second block section bounded by said second end surface and said intermediate point, a cross sectional area of said first block section along a plane parallel to said end surfaces being greater than a cross sectional area of said second block section along a plane parallel to said end surfaces.

6. The filter of claim 1, characterized in that it is a band pass filter.

7. The filter of claim 1, characterized in that it is a band rejection filter.

8. A dual band/dual mode radio system having a first operating frequency band and a second operating frequency band higher than the first frequency band, the system including a filter comprising impedance step resonators, each resonator having an open end and a short circuited end, the impedance of the open end being different from the impedance at the short circuited end, and where the fundamental frequency of the impedance step resonators is at the first operating frequency band of the radio system and a certain harmonic resonating frequency is at the second operating frequency band of the radio system.

* * * * *